United States Patent [19]

Fujitani et al.

[11] 4,443,775

[45] Apr. 17, 1984

[54] SOLENOID ACTUATOR

[75] Inventors: Hidetsugu Fujitani, Kasukabe; Tsuneo Ishigaki, Sugito; Tetsuro Tokuda, Misato, all of Japan

[73] Assignee: Shoketsu Kinzoku Kogyo Kabushiki Kaisha, Tokyo, Japan

[21] Appl. No.: 337,501

[22] Filed: Jan. 6, 1982

[30] Foreign Application Priority Data

Jan. 31, 1981 [JP] Japan ..... 56-13009[U]
Oct. 6, 1981 [JP] Japan ..... 56-148431[U]

[51] Int. Cl.[3] ..... H01F 3/00

[52] U.S. Cl. ..... 335/281; 335/251; 336/212

[58] Field of Search ..... 335/281, 251, 255, 202, 335/278; 174/35 D; 220/DIG. 25, 3.94, 4 C; 206/818; 336/83, 212; 310/42, 254; 29/609

[56] References Cited

U.S. PATENT DOCUMENTS 3,145,327 8/1964 Thayer, Jr. et al. ..... 335/251
3,523,362 8/1970 Wilk ..... 29/609

FOREIGN PATENT DOCUMENTS 1489622 4/1971 Fed. Rep. of Germany .

*Primary Examiner*—Harold Broome
*Attorney, Agent, or Firm*—Oblon, Fisher, Spivak, McClelland & Maier

[57] ABSTRACT

A solenoid actuator of high performance comprising a coil surrounded externally with a magnetic frame and having a stationary core disposed therein, with a movable core attracted to the stationary core upon energizing the coil being disposed axially slidably, wherein the magnetic frame comprises a pair of magnetic frame parts each fabricated from a sheet material by bending the sheet so as to define a top plate and a bottom plate integrally joined with a side plate for covering the top, bottom and side of the coil, and the pair of magnetic frame parts are assembled to each other with their top plates and bottom plates being overlapped to each other, to thereby provide simplified structure and easy assembling.

5 Claims, 9 Drawing Figures

SOLENOID ACTUATOR

BACKGROUND OF THE INVENTION

1. Field of the Invention

This invention concerns a solenoid actuator for use with electromagnetic valves adapted to change the flowing direction of fluid mainly by electromagnetic operation force.

2. Disclosure of Prior Art

A magnetic frame for a solenoid actuator, for example, as shown in FIG. 1 has heretofor been known. The magnetic frame comprises a frame main body 10 having a top plate 11 integrally joined with right and left side plates 12, 13, a bottom plate 14 attached between the lower ends of the side plates 12, 13 by engaging projections 17, 17 provided respectively at the lower ends of the side plates 12, 13 into recesses 18, 19 formed in magnetic flux plates 15, 16 and a magnetic flux plate 20 overlapped with the top plate 11. The thickness for the portion of the top plate 11 overlapped with the magnetic flux plate 20 and that of the bottom plate 14 overlapped with the magnetic flux plates 15, 16 are increased by the overlapping so that the joining areas between each of the central apertures 21, 22 formed in these plates and a stationary core or a movable core to be inserted therein is made equal to or greater than the cross sectional area S of the core. In such a magnetic frame, however, air gaps are present at the abutments 23, 24, 25 between the lower ends of the side plates 12, 13 and the magnetic flux plates 15, 16 and the like that form great magnetic resistance to worsen the performance.

SUMMARY OF THE INVENTION

This invention has been made in view of the foregoing and an object thereof is to provide a solenoid actuator of high performance with less magnetic loss wherein a magnetic frame comprises a pair of magnetic frame parts whose top plates and bottom plates are overlapped to each other for eliminating the abutments and thus the air gaps inevitable so far in the conventional magnetic frame.

Another object of this invention is to provide a solenoid actuator wherein the magnetic frame can be manufactured simply by applying press work to ferromagnetic sheet materials thereby enabling to reduce the manufacturing cost.

Another object of this invention is to provide a solenoid actuator wherein a gap is provided between the top plate or the bottom plate of one magnetic frame part and the side plate of the other magnetic frame part necessarily formed as the result of decreasing the overlapping width between the top plate and the bottom plate and the gap can be effectively utilized as the space for the connection of lead wires.

A further object of this invention is to provide a solenoid actuator wherein a partition chamber is provided in a stepped portion on one end plate of a bobbin for engagement with said gap to conduct connection works between windings and lead wires in the chamber to thereby prevent the occurence of electrical accidents such as short-circuit caused by the contact with windings and eliminate the use of additional space around the periphery of the coil for the connection works, to enable effective utilization for the winding space of the coil.

A futher object of this invention is to provide a solenoid actuator wherein slits are recessed in the top plates and the bottom plates of magnetic frame parts that can suppress the generation of eddy current and permit effective utilization of available electrical power.

A still further object of this invention is to provide a solenoid actuator wherein said slits and the projections formed on the end plate of the bobbin are engaged to each other for permitting accurate assembling of a pair of magnetic frame parts, as well as recesses and protrusions are provided to the side edges of the slits and side of the projections respectively to enable the positioning of the pair of the magnetic frame parts in assembling and disassembling directions by the engagement therebetween.

The foregoing objects can be attained by the solenoid actuator according to this invention having a coil formed by applying windings around a bobbin and a magnetic frame disposed around the coil, with a stationary core being disposed securely and a movable core attracted to the stationary core upon energizing the coil being disposed axially slidably at the center of the coil, wherein the magnetic frame comprises a pair of magnetic frame parts each fabricated from a ferromagnetic sheet material by bending the both ends thereof so as to define a top plate and a bottom plate integrally joined to the both ends of a side plate respectively for covering the top, bottom and side of the coil, and the pair of magnetic frame parts are assembled with their top plates and the bottom plates being overlapped to each other.

In the magnetic frame comprising the pair of magnetic frame parts, each of the overlapping size between the top plates and between the bottom plates is decreased within a range capable of affording a sufficient magnetic flux path, a gap is formed between the leading end of the top plate or the bottom plate of one magnetic frame part and the side plate of the other magnetic frame part in the magnetic frame, a stepped portion is provided on the end plate of said bobbin for engagement with the gap, and a partition chamber is formed in the stepped portion capable of containing the connection portions between the lead wires and windings while isolating them from the windings, whereby connection works between the windings and the lead wires are made possible in the partition chamber. Slits are recessed in the top plates and the bottom plates in the magnetic frame parts for elimination of eddy current loss, whereby effective utilization of available power suppy is enabled. Further, projections are provided on the upper and the lower end plates of the bobbin for engagement with the slits formed in the top plate and the bottom plate each disposed inner side in the magnetic frame, whereby assembling of the pair of magnetic frame parts can be facilitated. Furthermore, recesses are formed to the side edges of the slits and protrusions for engagement with the recesses are formed to the sides of said projections to permit the positioning of the pair of magnetic frames in the assembling and disassembling direction.

DESCRIPTION OF THE PREFERRED EMBODIMENT

Figure 2:
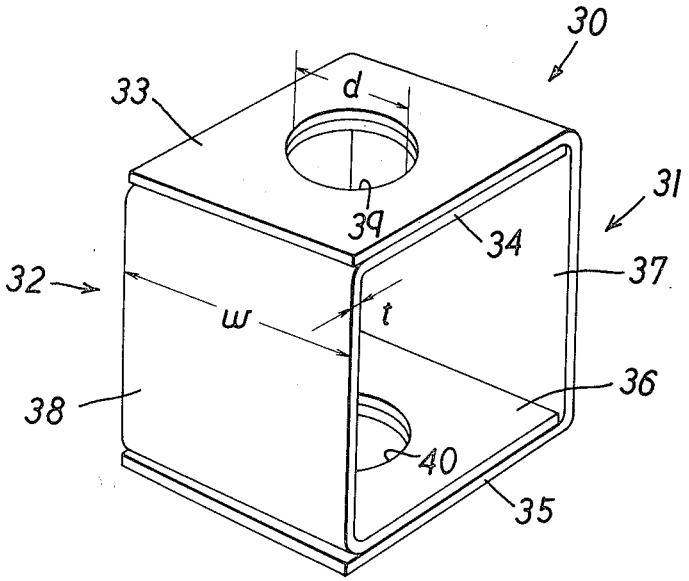
FIG. 2 is a perspective view of a magnetic frame in the first embodiment of this invention.
Figure 3:
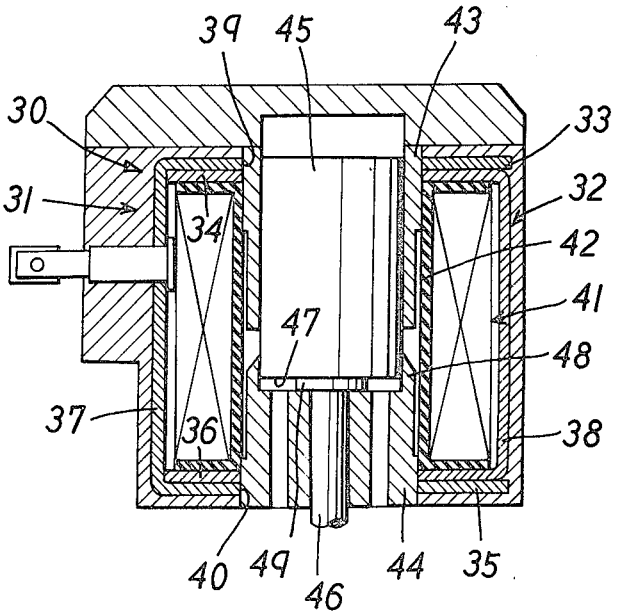
FIG. 3 is a cross sectional view of a solenoid actuator having the magnetic frame shown in FIG. 2 incorporated therein.

FIG. 2 and FIG. 3 show the first embodiment of this invention, wherein a magnetic frame 30 comprises a pair of magnetic frame parts 31, 32 formed from ferromagnetic metal sheets such as iron sheets of a uniform thickness by bending them generally each in a U-shaped shape and engaging them to each other. The magnetic frame part 31 comprises a top plate 33 and a bottom plate 35 integrally joined respectively at the upper and lower ends of a side plate 37 for covering the upper surface, the bottom surface and the side surface of a bobbin 42 in a coil 41 as shown in FIG. 3. The other magnetic frame part 32 comprises a top plate 34 and a bottom plate 36 integrally joined respectively to the upper and lower ends of a side plate 38 for covering the bobbin 42 in the coil 41 in the same manner. The length of the side plate 37 for the magnetic frame part 31 is made greater than that of the side plate 38 of the other magnetic frame part 32 by twice of the plate thickness. Accordingly, the magnetic frame parts 31, 32 are assembled in such a way that the former contains, in its inside, the latter with the top plate 33 being overlapped to the upper surface of the top plate 34 and with bottom plate 35 being overlapped to the lower surface of the bottom plate 36. Apertures 39, 40 are formed through the top plates 33, 34 and the bottom plates 35, 36 respectively. The joining area between each of the apertures 39, 40 and the stationary cores 43, 44 to be inserted to fix therein (shown in FIG. 3) is made equal to or greater than the effective cross sectional area S of the core, that is, it is set so as to satisfy the following relation:

$$S \leqq 2\pi dt,$$

where d represents the diameter for the apertures 39, 40 and t represents the plate thickness for the magnetic frame parts 31, 32.

The plate material employed has such a dimension as to satisfy the following relation:

$$S \leqq 2\ wt,$$

where w represents the plate width for the magnetic frame parts 31, 32.

FIG. 3 shows an embodiment wherein the magnetic frame referred to above is applied to a so-called proportional solenoid actuator capable of producing output in proportion to the value of electrical current. To the center of the coil 41 surrounded with the magnetic frame 30, are disposed stationary cores 43, 44 opposing to the inner sufaces of the apertures 39, 40 formed in top plates 33, 34 and the bottom plates 35, 36, and a movable core 45 to be attracted to the stationary core 44 upon energizing is disposed axially slidably.

In the proportional solenoid actuator, the movable core 45 is attracted to the stationary core 44 against the resiliency of a return spring or the like (not shown) exerted by way of a push rod 46 upon energizing the coil 41. In this case, while the attraction force between the movable core 45 and the stationary core 44 is increased gradually as the former approaches the latter in a range where the lower end face 47 of the movable core 45 does not come closer to the top end at the annular wall 48 of the stationary core. Then, when the lower end face 47 of the movable core 45 further approaches the stationary core 44 exceeding the top end of the annular wall 48 thereof, the attraction force between the movable core 45 and the annular wall 48 of the stationary core 44 comes to contain such a component as opposing to the attraction force between the lower end face 47 of the movable core 45 and the opposing upper surface of the stationary core 44. As the result, the attraction force between the cores is made almost constant in this range, that is, a proportional relation is established between the attraction force and the current value irrespective of the moving stroke of the movable core 45. If the movable core 45 further approaches the stationary core 44, the attraction force between them is increased rapidly whereby the above proportional relation is lost. Accordingly, a spacer 49 is put between the cores 44 and 45 so as to restrict the stroke of the movable core 45.

Figure 4:
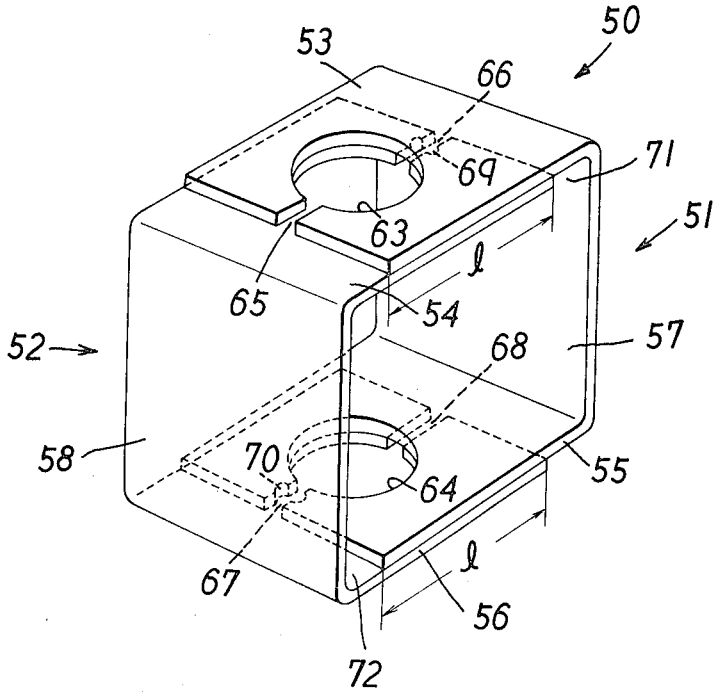
FIG. 4 is a perspective view of a magnetic frame in the second embodiment of this invention.
Figure 5:
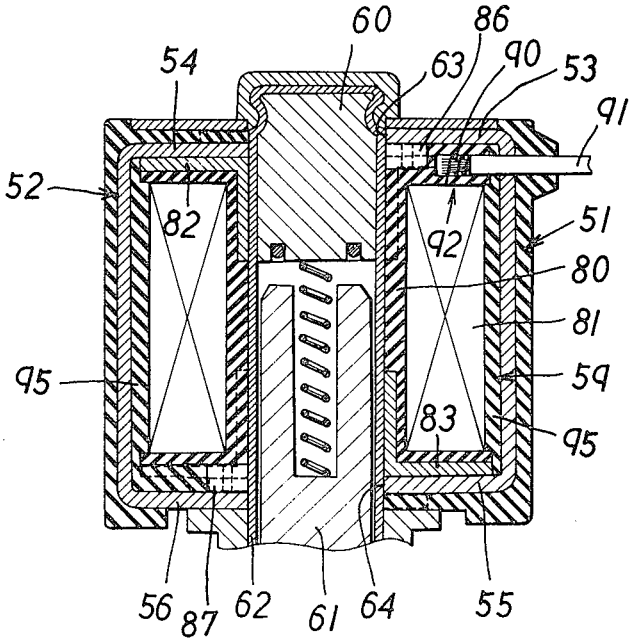
FIG. 5 is a cross sectional view of a solenoid actuator having the magnetic frame shown in FIG. 4 incorporated therein.

FIG. 4 and FIG. 5 shows the second embodiment of this invention, wherein a magnetic frame 50 comprises magnetic frame parts 51, 52 of a same configuration. The magnetic frame parts 51, 52 having side plates 57, 58 of a same length are assembled to each other by abutting to overlap the top plate 53 and the bottom plate 55 of one magnetic frame part 51 on the upper surfaces of the top plate 54 and the bottom plate 56 of the other magnetic frame part 52 respectively. Apertures 63, 64 are formed in the overlapped portions of them for fitting therein a guide pipe 62 through which a stationary core 60 and a movable core 61 attracted to the stationary core 60 are engaged while aligned with the center of the coil 59 (FIG. 5). Slits 65, 66 are recessed from the middle of the end edges of the top plates 53, 54 to the peripheral edges of the aperture 63 respectively and slits 67, 68 are recessed from the middle of the edges of the bottom plates 55, 56 to the aperture 64 respectively for elimination of eddy current loss. Recesses 69, 70 are formed respectively to the slits 66, 67 in the top plate 54 and the bottom plate 55 disposed to the inner side in the magnetic frame 50.

The overlapped length l between the top plates 53, 54 and between the bottom plates 55, 56 in the magnetic frame part 51 and the magnetic frame part 52 can be set to a desired small size within such a range as can include the apertures 63, 64 at the center of the overlapped areas and afford a sufficient magnetic flux path, thereby leaving gaps 71, 72 between each of the side plates 57, 58 and each of their opposing top ends of the top plate 54 and the bottom plate 55 disposed to the inner side in the magnetic frame 50 respectively.

Figure 6:
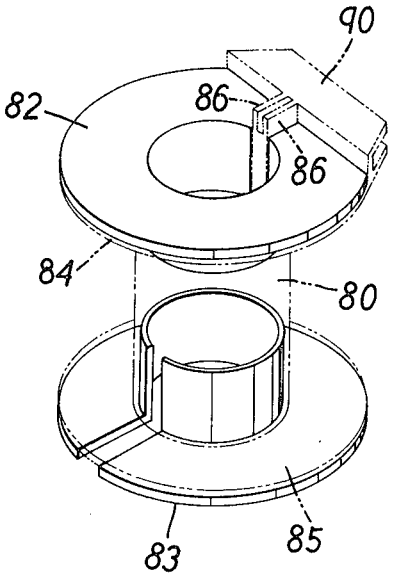
FIG. 6 is a perspective view of an auxiliary magnetic frame used in the solenoid actuator shown in FIG. 5.
Figure 7:
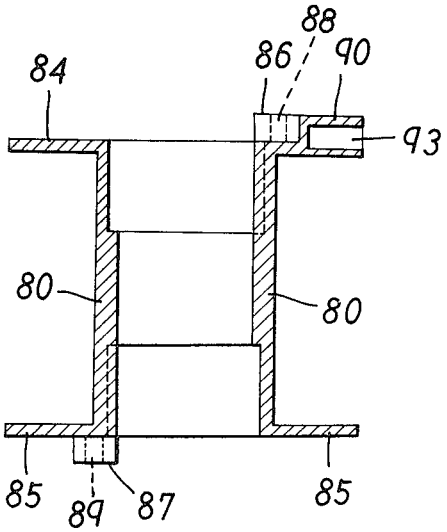
FIG. 7 is a cross sectional view of a bobbin used in the solenoid shown in FIG. 5.
Figure 8:
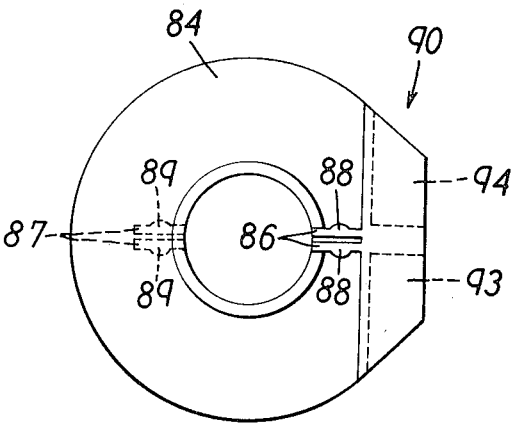
FIG. 8 is a plan view thereof.

The coil 59 comprises a bobbin 80 having auxiliary magnetic frames 82, 83 made of flanged ferromagnetic material fitted at the upper end and the lower ends thereof, as shown in FIG. 6, and windings 81 wound around the bobbin 80. As shown in FIG. 7 and FIG. 8, each pair of resilient projections 86, 86 and 87, 87 is formed at the upper and the lower surfaces of flanged end plates 84, 85 of the bobbin 80 at positions symmetrical with each other to the axial center of the bobbin for fitting engagement with the slits 66, 67 at the top plate 54 and the bottom plate 55 disposed to the inner side of the magnetic frame 50 respectively. Protrusions 88, 89 are formed to the side of the projections 86, 87 for engagement with the recesses 69, 70 respectively, whereby the accurate assembling for the magnetic frame parts 51, 52 is enabled due to the engagement between the projections 86, 87 and the slits 66, 67 as well as the positioning is attained for the magnetic frame parts 51, 52 in the assembling and disassembling directions due to the engagement between the protrusions 88, 89 and the recesses 69, 70. The auxiliary magnetic frames 82, 83 are provided for reinforcing the bobbin 80 molded from synthetic resin, as well as for increasing the cross sectional area of the magnetic flux path between the stationary core 60 and the magnetic frame 50 and between the movable core 61 and the magnetic frame 50 to decrease the magnetic resistance therebetween. Further, a step 90 is formed on the upper end plate 84 of the bobbin 80 for engagement with the gap 71 formed within the magnetic frame 50. Partition chambers 93, 94 are formed within the step 90 for containing connections between the both ends of the winding 81 and the lead wires 91 from a power source while isolating the connection portions 92 from the winding 81.

In the drawing, reference numeral 95 represents synthetic resin for molding the coil 59 together with the magnetic frame 50.

In the solenoid actuator having the foregoing constitution, when current is supplied to the coil 59 through the lead wires 91, a magnetic circuit is established in the route from the magnetic frame 50 passing through the stationary core 60 and the movable core 61 and to the magnetic frame 50, whereby the movable core 61 is attracted to the stationary core 60. In this case, no particular troubles will occur if no close contacts are formed between the top plate 53, 54 and between the bottom plate 55, 56 to each other in the magnetic frame parts 51, 52, since the magnetic flux circulates passing between the top plates 53, 54 and the stationary core 60 and between the bottom plates 55, 56 and the movable core 61.

Figure 1:
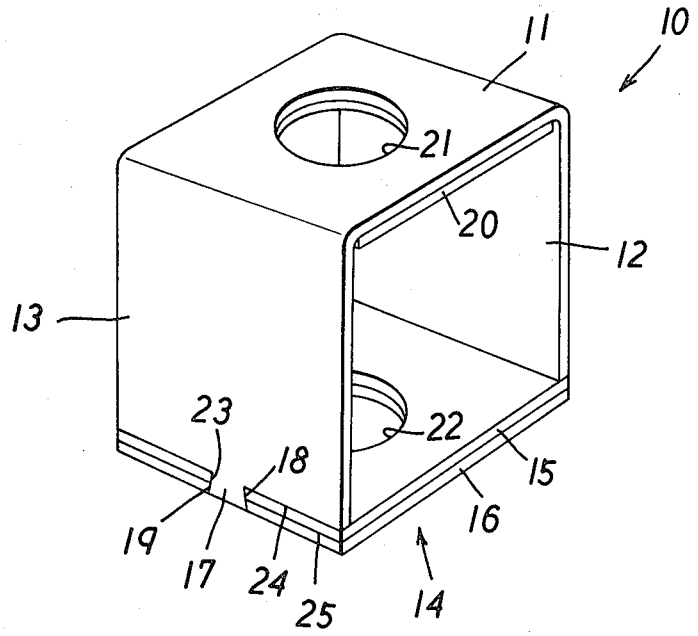
FIG. 1 PRIOR ART
FIG. 1 is a perspective view of a conventional magnetic frame for use with solenoid actuators.
Figure 9:
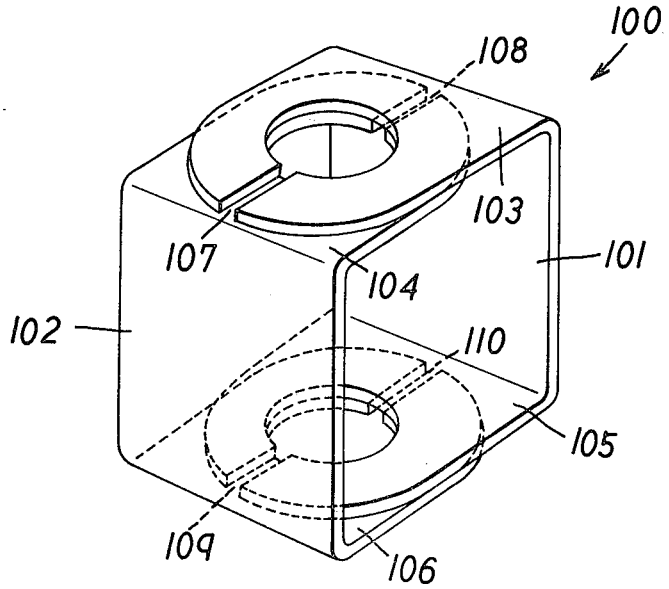
FIG. 9 is a perspective view of a magnetic frame in the third embodiment of this invention.

FIG. 9 shows the third embodiment of this invention, wherein a magnetic frame 100 comprises a pair of magnetic frame parts 101, 102 having a top plate 103 and a bottom plate 105, and a top plate 104 and a bottom plate 106 respectively, each top end of which is formed into an arc-shaped circumference within such a range as capable of providing a required area for the cross section of the magnetic flux path. Slits 107, 108, 109, 110 are recessed in the same manner as in foregoing embodiments for elimination of eddy current loss. The slits 108, 109 may also be utilized for setting the bobbin by engaging therein those projections formed on the bobbin of the coil in the same manner as shown in the second embodiment.

In each of the foregoing embodiments, it is desired to join the overlapped top plates and the bottom plates to each other by spot welding or the like for minimizing the air gaps therebetween.

What is claimed is:

1. A solenoid actuator comprising:

a coil formed by applying windings around a bobbin including top and bottom end plates;

a magnetic frame comprising a pair of magnetic frame parts each fabricated from a ferromagnetic sheet material by bending the both ends thereof so as to define a top plate and a bottom plate integrally connected to the both ends of a side plate respectively for covering the top, bottom and side of the coil, said top and bottom plates of said magnetic frame parts each defining a leading edge opposite the integral connection thereof to the respective side plate;

said pair of magnetic frame parts assembled with their top plates and the bottom plates being overlapped to each other, with the overlap between said top plates and between said bottom plates selected to afford a sufficient magnetic flux path and to form a gap for containing connection portions of lead wires for making electrical connection to said windings, said gap formed between the leading edge of a selected one of the top and bottom plates of one of said frame parts and the side plate of the other frame part; and said bobbin further comprising a stepped portion on a selected of the end plates thereof to define a partition chamber, said stepped portion disposed in said gap, said partition chamber adapted to contain said connection portions between said lead wires and said windings to isolate said lead wires from said windings except for said connection portions.

2. A solenoid actuator according to claim 1, comprising:

said magnetic frame parts having slits recessed in the top plates and in the bottom plates thereof for eliminating eddy current losses; and said upper and lower end plates of said bobbin having projections for engaging the slits formed in the top and bottom plates of said frame parts.

3. The solenoid actuator of claim 2, comprising:

said slits of said top and bottom plates of said frame parts defining side edges having recesses formed therein; and said projections of said top and bottom end plates of said bobbin disposed in engagement with said recesses formed in said side edges.

4. A solenoid actuator comprising:

a coil formed by applying windings around a bobbin including top and bottom end plates;

a magnetic frame comprising a pair of magnetic frame parts each fabricated from a ferromagnetic sheet material by bending the both ends thereof so as to define a top plate and a bottom plate integrally connected to the both ends of a side plate respectively for covering the top, bottom and side of the coil, said top and bottom plates of said magnetic frame parts each defining a leading edge opposite the integral connection thereof to the respective side plate;

said pair of magnetic frame parts assembled with their top plates and the bottom plates being overlapped to each other, with the overlap between said top plates and between said bottom plates selected to afford a sufficient magnetic flux path and to form a gap for containing connection portions of lead wires for making electrical connection to said windings, said gap formed between the leading edge of a selected one of the top and bottom plates of one of said frame parts and the side plate of the other frame part;

said magnetic frame parts having slits recessed in the top plates and in the bottom plates thereof for eliminating eddy current losses; and said upper and lower end plates of said bobbin having projections for engaging the slits formed in the top and bottom plates of said frame parts.

5. The solenoid actuator of claim 4, comprising:

said slits of said top and bottom plates of said frame parts defining side edges having recesses formed therein; and said projections of said top and bottom end plates of said bobbin disposed in engagement with said recesses formed in said side edges.

* * * * *